United States Patent [19]

Liao et al.

[11] Patent Number: 4,756,816

[45] Date of Patent: Jul. 12, 1988

[54] ELECTRODEPOSITION OF HIGH MOMENT COBALT IRON

[75] Inventors: Simon H. Liao, Edina; Charles H. Tolman, Bloomington, both of Minn.

[73] Assignee: Magnetic Peripherals, Inc., Minneapolis, Minn.

[21] Appl. No.: 56,089

[22] Filed: May 29, 1987

[51] Int. Cl.[4] ..... C25D 3/56

[52] U.S. Cl. ..... 204/44.5

[58] Field of Search ..... 204/44.5

[56] References Cited

U.S. PATENT DOCUMENTS

| | | | |
|---|---|---|---|
| 2,507,400 | 5/1950 | De Marinis | 204/44.5 |
| 4,014,759 | 3/1977 | McMullen et al. | 204/44.5 |
| 4,053,373 | 10/1977 | McMullen et al. | 204/44.5 |
| 4,102,756 | 7/1978 | Castellani et al. | 204/44.5 |
| 4,208,254 | 6/1980 | Mitsumoto et al. | 204/44.5 |
| 4,430,171 | 2/1984 | Lemke et al. | 204/44.5 |
| 4,526,968 | 7/1985 | Lemke et al. | 546/139 |
| 4,661,216 | 4/1987 | Anderson et al. | 204/44.5 |

OTHER PUBLICATIONS

J. K. Howard, "Thin Films for Magnetic Recording Technology", Solid State Physics, 12/3/84.

Y. Hoshi et al., IEEE, Sep. 1986.

S. Glasstone et al., Faraday Soc. Trans., vol. 28, pp. 733–740, (1932).

S. Glasstone et al., Faraday Soc. Trans., vol. 29, pp. 426–429, (1933).

J. C. Sadak et al., Plating and Surface Finishing, pp. 34–37, April 1978.

*Primary Examiner*—G. L. Kaplan

*Attorney, Agent, or Firm*—Joseph J. Kaliko

[57] ABSTRACT

Ferromagnetic cobalt-iron (CoFe) is electrodeposited on a conductive substrate to form a CoFe thin film. The wet electrodeposition process disclosed involves use of a relatively low toxic plating bath solution in which the constituents cobalt and iron are introduced as soluble salts. A lesser amount of iron than cobalt is used to develop an approximately 90% cobalt to 10% iron ratio in the thin film. The plating solution also has sodium saccharin, dodecyl sodium sulfate and wetting and buffering agents. The CoFe thin film that results from using the disclosed process has near zero magnetostriction, acceptable permeability for use as a magnetic head, a highly stabilized magnetic domain and approximately twice the saturation moment of Permalloy. Magnetic heads fabricated from such film are well suited for use with high coercivity media for high density recording.

20 Claims, No Drawings

ELECTRODEPOSITION OF HIGH MOMENT COBALT IRON

BACKGROUND OF THE INVENTION

1. Field of the Invention

This invention relates generally to electrodeposition processes used for making CoFe alloy thin film and more particularly relates to a process which utilizes a low toxic bath at relatively low operating temperatures to produce a CoFe thin film having magnetic properties well suited for the fabrication of magnetic heads.

2. Description of the Relevant Art

Electroplating methods, as well as electrochemical treatment and plating apparatus for the electrodeposition of thin film alloy on a substrate, are well known. For example, Castellani et al, in the U.S. Pat. No. 4,103,756, issued July 25, 1978, teaches methods and apparatus for electroplating Permalloy (NiFe) on a substrate.

According to Castellani et al, a thin film of low magnetostriction Permalloy, of approximately 80% nickel and 20% iron, is electroplated onto the substrate in a bath having a ratio of about 1.8:1 to 24:1 g/liter of Ni to Fe ions with a plating current density of 10 ma/cm$^2$ to 200 ma/cm$^2$ when plating in sheet form; and an Ni/Fe ratio of 25:1 to 85:1 with a current density of 2 ma/cm$^2$ to 110 ma/cm$^2$ when plating through a mask. The plating bath fluid in the Castellani et al system is constantly mixed, replenished, etc. in a temperature controlled environment to provide the appropriate electrolyte to facilitate the electrodeposition of the desired Permalloy thin film.

Electrodeposited Permalloy thin films have been widely used in magnetic storage applications as recording cores because of their superior magnetic properties such as high saturation moment, near zero magnetostriction, and high permeability.

As recording densities increase, recording media with higher coercivity are needed in order to increase output through reducing self demagnetizing loss. As a result, it is necessary to have a recording core with saturation moment high enough to magnetize such high coercivity media.

In an effort to develop a thin film head for use with high density media with saturation moment and other magnetic properties superior to Permalloy, a variety of thin film alloys and fabrication processes have evolved.

An example of electrodeposition to create a thin film on a substrate using cobalt and iron is taught in Mitsumoto et al, U.S. Pat. No. 4,208,254, issued June 17, 1980. The resulting alloy has a 7.5%–55% iron and 92.5%–45% cobalt composition and is obtained using a plating bath containing a fluoride.

The alloy produced by the Mitsumoto et al technique has high magnetostriction but can be produced using a plating bath requiring a relatively low temperature while plating is in progress. Before Mitsumoto et al, high temperatures, in the range of 80° C. to 90° C. were required to plate CoFe alloy when a bath, composed of cobalt chloride, ferrous chloride and calcium chloride, for example, was used.

For Mitsumoto's end use high magnetostriction was desirable. However, this characteristic is not desirable for magnetic heads. Additionally, the Mitsumoto et al fluoride plating bath is a relatively hazardous, toxic fluid. Accordingly, it would be desirable to find a substitute, relatively low toxic bath for use in CoFe plating yielding a near zero magnetostriction thin film.

Other known CoFe deposition techniques involve dry (non-electrolyte) methods such as vacuum evaporation or sputtering techniques. These vacuum techniques require a relatively high operating temperature, usually in excess of 250° C., and yield films with relatively poor magnetic properties when compared to electoplated films.

In view of the foregoing, it has been determined that it would be desirable to fabricate a CoFE thin film having a saturation moment greater than Permalloy, in a low termperature environment, using an electrodeposition process that does not require a highly toxic bath and which yelds thin film with other overall acceptable magnetic properties for use in fabricating a magnetic head. Such properties include, as indicated hereinbefore, a thin film having, in addition to high saturation moment, near zero magnetostriction, good permeability and a stable magnetic domain.

SUMMARY OF THE INVENTION

According to the invention, ferromagnetic cobalt-iron (CoFe) is electrodeposited on a conductive substrate to form a CoFe thin film. A wet electrodeposition process is disclosed that involves use of a relatively low toxic plating bath solution in which the constituents cobalt and iron are introduced as soluble salts. A lesser amount of iron than cobalt is used to develop an approximately 90% cobalt to 10% iron ratio in the thin film. The plating solution also has sodium saccharin, dodecyl sodium sulfate and wetting and buffering agents.

The CoFe thin film that results from using the disclosed electrodeposition process and bath has near zero magnetostriction, acceptable permeability for use as a magnetic head, a highly stabilized magnetic domain and approximately twice the saturation moment of Permalloy. Magnetic heads fabricated from such film are well suited for use with high density, high coercivity recording media.

It is an object of the invention to provide a relatively low toxic plating bath solution, suitable for use in an electrodepostion process, for developing a thin film of CoFe with high saturation moment.

It is a further object of the invention to provide a plating bath solution for use in an electrodeposition process where the bath temperature at which plating is performed need only be maintained at a relatively low temperature as compared with known CoFe plating solutions and processes.

It is still a further object of the invention to provide a plating bath solution suitable for use in an electrodeposition process that yields a CoFe thin film in the 2 micron range where the film exhibits overall magnetic characteristics which makes it suitable for fabricating magnetic heads particularly well adapted to be used in conjunction with high coercivity media for high density recording.

The invention features a plating bath realizing all of the above objectives simultaneously. The CoFe film that results using the aforesaid bath and process has all of the aforementioned desirable magnetic characteristics. Additionally, the relatively low toxic bath for the disclosed CoFe electrodeposition process addresses environmental concerns associated with such processes.

These and other objects and features of the present invention will be apparent from the following detailed description of the invention.

DETAILED DESCRIPTION

More specifically, the plating solution includes the following constituents substantially in the ranges indicated:

TABLE

| Constituent: | Quantity gms./liter |
|---|---|
| Cobalt Sulfate [$CoSO_4.7H_2O$] | 100–120 |
| Iron Sulfate [$FeSO_4.7H_2O$] | 7–10 |
| Boric Acid [$H_3BO_3$] | 25–35 |
| Sodium Saccharin [$C_7H_4NNaO_3S.2H_2O$] | 1–3 |
| Dodecyl Sodium Sulfate [$CH_3(CH_2)_{11}OSO_3Na$] | 0.1–0.5 |

The preferable bath temperature range is 30° C. to 40° C. Preferably the pH is maintained in a range of 3 to 4. The preferred current for performing the electrodeposition is 0.5 amp to 2 amps yielding a current density range of 5 ma/cm$^2$ to 20 ma/cm$^2$.

The substrate on which the CoFe thin film is to be deposited is held at the cathode of an electroplating cell such as the cell taught in the aforementioned Castellani et al, U.S. Pat. No. 4,102,756, which is hereby incorporated by reference.

The bath, prepared in accordance with the teachings herein, is placed in the cell and a current in the range indicated hereinbefore is applied. As one of ordinary skill in the art will readily appreciate, the deposition rate will increase as current is increased. However, as will be seen hereinafter with reference to the examples, the deposition rate should be kept within the limits that can be achieved with the specified current density range or degradation of the magnetic properties of the resulting thin film will occur.

As indicated hereinbefore and shown in the table, the cobalt and iron are introduced as soluble salts. The boric acid shown in the table is used as a pH buffer to maintain a relatively constant pH in the bath.

The sodium saccharin acts as a stress relieving agent. Finally, the dodecyl sodium sulfate is a surfactant used to eliminate pitting.

Also, as indicated before, the departure from fluoride constituents to sulfate constituents in the bath results in a solution having lower toxicity.

The relatively low amount of iron as compared with cobalt in the solution yields the approximately 90% cobalt, 10% iron alloy having a saturation moment of 19 kilogauss which is nearly twice the saturation moment of 82/18 Permalloy.

The resultant anisotropic field, $H_k$, is approximately 10 Oe., compared to 3 Oe. for Permalloy. However, the resultant permeability for the CoFe film is approximately 2000, i.e., well suited for fabricating a magnetic head, and the relatively high $H_k$, as compared with Permalloy, helps stabilize the magnetic domains of the film.

The following examples illustrate the practice of the invention, however the invention is not limited to these specific values.

EXAMPLE 1

| | | |
|---|---|---|
| $CoSO_4.7H_2O$ | 105 | grams/liter |
| $FeSO_4.7H_2O$ | 9 | |
| Boric Acid | 30 | |
| Sodium Saccharin | 2.0 | |
| Dodecyl Sodium Sulfate | .2 | |

The above bath with a deposition rate of 2000 angstroms per minute developed a 1 micron thick film with tensile stress insufficient to degrade the film's magnetic properties. The values indicated in this example constitute a preferred plating bath solution formulated in accordance with the teachings herein.

EXAMPLE 2

Using the same values as used in Example 1, but by increasing the deposition rate to 4000 angstroms per minute (i.e., outside the 5 ma/cm$^2$ to 20 ma/cm$^2$ current density range) yielded a 1 micron thick film with a composition of 91.5% Co and 8.5% Fe. However, high tensile stress degraded the magnetic properties of the film. This reinforced the conclusions reached regarding optimal deposition rate.

EXAMPLE 3

Again, using a deposition rate of 2000 angstroms per minute, like in Example 1, but varying the constituents of the bath such that the $FeSO_4.7H_2O$ was out of range, i.e., 5 gms/l instead of 9 gms/l, resulted in a film having a 1 micron thickness and a 94% Co to 6% Fe composition. The film was bright and shiny, however the magnetostriction was too negative rendering the film unsuitable for fabricating a magnetic head. This reinforced the conclusions reached regarding the aforesaid optimal constituent ranges for the bath.

Finally, the following table lists the magnetic properties of CoFe films produced by various techniques.

TABLE

| | Electropated | Vacuum Evaporated | Vacuum Sputtered |
|---|---|---|---|
| Film Thickness | 2 microns | 1000 to 5000 (angstroms) | 1000 to 5000 (angstroms) |
| Operating Temperature | 40° | Over 250° C. | Over 250° C. |
| $H_c$ | 4 Oe. | 18 Oe. | 20 Oe. |
| $H_k$ | 10–13 Oe. | 30 Oe. | 30 Oe. |
| Permeability (Approximate) | 1700 | 600 | 600 |

The first column of the table shows data obtained using the bath solution and process taught herein. The second and third colums were obtained from published references indicating the magnetic properties of CoFe film created via vacuum evaporation and vacuum sputtering methods.

The conclusions demonstrated by the table are that permeability, using the CoFe deposition techniques taught herein, is twice that obtained by vacuum evaporation methods and many times greater than sputtering methods.

The lower $H_k$ for the film made, using the bath and process disclosed herein, indicates that a lower current (and thus less heat by-product) is required to magnetize the media using a magnetic head fabricated from the film.

Thus the magnetic properties of the CoFe film resulting from using the disclosed bath and process is superior for use in fabricating magnetic heads when compared with film created by the other indicated processes.

The foregoing disclosure and description of this invention is illustrative only. Various changes may be made within the scope of the appended claims without departing from the spirit and scope of the invention.

What is claimed is:

1. An aqueous electrolytic plating bath for the deposition of a ferromagnetic coating on an electrically conductive substrate arranged as a cathode in the electrolytic deposition process, said bath (a) having a pH substantially in the range of 3.0 to 4.0; and (b) including as essential ingredients 1. dissolved cobalt sulfate ($CoSO_4.7H_2O$) in a concentration substantially between 100 and 120 grams per liter;
2. dissolved iron sulfate ($FeSO_4.7H_2O$) in a concentration substantially between 7 and 10 grams per liter; and
3. dissolved dodecyl sodium sulfate ($CH_3(CH_2)_{11}OSO_3Na$) in a concentration substantially between 0.1 and 0.5 per liter, whrein said dodecyl sodium sulfate acts as a surfactant to eliminate pitting.

2. A plating bath as defined in claim 1 further including sodium saccharin in sufficient amount to relieve stresses in the ferromagnetic coating.

3. A plating bath as defined in claim 2 wherein said sodium saccharin is present in a concentration substantially between 1 and 3 grams per liter.

4. A plating bath as defined in claim 1 further including dissolved boric acid ($H_3BO_3$) in a concentration substantially between 25 and 35 grams per liter, wherein the boric acid acts as a pH buffer to maintain bath pH in the aforesaid 3.0 to 4.0 range.

5. In a process for the electrodeposition of a cobalt-iron alloy on a substrate, wherein the cobalt-iron alloy consists of 89–93% by weight of cobalt and 11–7% by weight of iron and further wherein said electrodeposition on said substrate occurs in a plating bath, by applying an electolytic current thereto, the improvement which comprises using, as the plating bath, an aqueous bath containing;

(a) dissolved cobalt sulfate in a concentration substantially between 100 and 120 grams per liter;

(b) dissolved iron sulfate in a concentration substantially between 7 and 10 grams per liter;

(c) dissolved sodium saccharin in a concentration substantially between 1 and 3 grams per liter, wherein said sodium saccharin acts to relieve stress;

(d) dissolved boric acid in a concentration substantially between 25 and 35 grams per liter, wherein said boric acid acts as a pH buffer to maintain a bath pH in a range between 3 and 4; and (e) dissolved dodecyl sodium sulfate in a concentration substantially between 0.1 and 0.5 grams per liter, wherein said dodecyl sodium sulfate acts as a surfactant to eliminate pitting.

6. In a process as set forth in claim 5 further comprising the step of maintaining said plating bath at substantially 30° C. to 40° C. while employing a plating current density of about 5 ma/cm$^2$ to 20 ma/cm$^2$ to produce a CoFe deposite of uniform thickness.

7. The product of the process of claim 6.

8. The product of the process of claim 5.

9. A method for electroplating a near zero magnetostrictive CoFe film on an electrically conductive substrate via an electrolytic deposition process, comprising the steps of:

(a) preparing an electrolyte which includes:

1. sufficient cobalt sulfate ($CoSO_4.7H_2O$);
2. sufficient iron sulfate ($FeSO_4.7H_2O$) to develop an approximately 89% to 93% cobalt and 11% to 7% iron film on said substrate after the solution has been electrolyzed; and
3. adding sufficient boric acid ($H_3BO_3$) to said solution to maintain a solution pH of substantially between 3.0 and 4.0 in value;

(b) arranging said substrate as a cathode in said electrolyte; and (c) electrolyzing said solution by the passage of from 5 ma/cm$^2$ to 20 ma/cm$^2$ at a temperature of from about 30° C. to 40° C., whereby a uniformly thick, near zero magnetostrictive film is deposited on said substrate.

10. A method as set forth in claim 9 wherein said step of preparing said electrolyte further includes adding sufficient sodium saccharin ($C_7H_4NNaO_3S.2H_2O$) to said solution to relieve stress in said film deposited on said substrate.

11. A method as set forth in claim 10 wherein said step of preparing said electrolyte further includes adding sufficient dodecyl sodium sulfate to said solution to avoid pitting of the film deposited on said substrate.

12. An aqueous electrolytic plating bath for the deposition of a cobalt iron ferromagnetic coating on an electrically conductive substrate arranged as a cathode.in the electrolytic deposition process, said bath (a) having a pH substantially in the range of 3.0 to 4.0; and (b) consisting essentially of:

1. dissolved cobalt sulfate ($CoSO_4.7H_2O$) in a concentration substantially between 100 and 120 grams per liter, and
2. dissolved iron sulfate ($FeSO_4.7H_2O$) in a concentration substantially between 7 and 10 grams per liter.

13. A plating bath as defined in claim 12 further including sodium saccharin ($C_7H_4NNaO_3S.2H_2O$) in sufficient amount to relieve stresses in the ferromagnetic coating.

14. A plating bath as defined in claim 13 wherein said sodium saccharin is present in a concentration substantially between 1 and 3 grams per liter.

15. A plating bath as defined in claim 12 further including dissolved boric acid ($H_3BO_3$) in a concentration substantially between 25 and 35 grams per liter, wherein the boric acid acts as a pH buffer to maintain bath pH in the aforesaid 3.0 to 4.0 range.

16. A plating bath as defined in claim 12 further including dissolved dodecyl sodium sulfate ($CH_3(CH_2)_{11}OSO_3Na$) in a concentration substantially between 0.1 and 0.5 grams per liter, wherein said dodecyl sodium sulfate acts as a surfactant to eliminate pitting.

17. In a process for the electrodeposition, a cobalt-iron alloy on a substrate, wherein the cobalt-iron alloy consists of 89–93% by weight of cobalt and 11–7% by weight of iron and further wherein said electrodeposition on said substrate occurs in a plating bath, by applying an electrolytic current thereto, the improvement which comprises using, as the plating bath, an aqueous bath consisting essentially of:

(a) dissolved cobalt sulfate ($CoSO_4.7H_2O$) in a concentration substantially between 100 and 120 grams per liter;

(b) dissolved iron sulfate ($FeSO_4.7H_2O$) in a concentration substantially between 7 and 10 grams per liter;

(c) dissolved sodium saccharin ($C_7H_4NNaO_3S.2H_2O$) in a concentration substantially between 1 and 3 grams per liter, wherein said sodium saccharin acts to relieve stress;

(d) dissolved boric acid ($H_3BO_3$) in a concentration substantially between 25 and 35 grams per liter, wherein said boric acid acts as a pH buffer to maintain a bath pH in a range between 3 and 4; and (e) dissolved dodecyl sodium sulfate ($CH_3(CH_2)_{11}OSO_3Na$) in a concentration substantially between 0.1 and 0.5 grams per liter, wherein said dodecyl sodium sulfate acts as a surfactant to eliminate pitting.

18. In a process as set forth in claim 17 further comprising the step of maintaining said plating bath at substantially 30° C. to 40° C. while employing a plating current density of about 5 ma/cm$^2$ to 20 ma/cm$^2$ to produce a CoFe deposit of uniform thickness.

19. The product of the process of claim 18.

20. The product of the process of claim 17.

* * * * *